US006956446B2

(12) United States Patent
Genfan et al.

(10) Patent No.: US 6,956,446 B2
(45) Date of Patent: Oct. 18, 2005

(54) NONRECIPROCAL DEVICE HAVING HEAT TRANSMISSION ARRANGEMENT

(75) Inventors: German S. Genfan, Newton, MA (US); Karen Kocharyan, Burlington, MA (US)

(73) Assignee: Renaissance Electronics Corporation, Harvard, MA (US)

( * ) Notice: Subject to any disclaimer, the term of this patent is extended or adjusted under 35 U.S.C. 154(b) by 119 days.

(21) Appl. No.: 10/737,828

(22) Filed: Dec. 18, 2003

(65) Prior Publication Data

US 2005/0134399 A1 Jun. 23, 2005

(51) Int. Cl.[7] ..... H01P 1/36; H01P 1/26

(52) U.S. Cl. ..... 333/24.2; 333/22 R; 361/712; 361/709

(58) Field of Search ..... 333/24.2, 1.1, 333/22 R; 361/712, 704, 707, 709

(56) References Cited

U.S. PATENT DOCUMENTS 5,208,561 A * 5/1993 Delestre et al. ..... 333/22 R
5,912,507 A * 6/1999 Dunn et al. ..... 257/767
5,923,077 A * 7/1999 Chase et al. ..... 257/536

* cited by examiner

*Primary Examiner*—Stephen E. Jones

(57) ABSTRACT

An isolator with resistive termination and carbon steel housing wherein required magnetic performance is combined with improved efficiency of transmission of heat from termination to the heat sink. The improvement is achieved due to the copper/aluminum plug that mechanically and electrically connects the soldering base of termination to the base of isolator, which in operation is installed on the heat sink. The plug is pressed into the housing from the base side to provide tight coplanarity tolerance to exposed end of the plug and the base without any secondary machining. The termination is soldered to the opposite end of the plug, which is flush to or slightly above the top surface of the housing. Thus, magnetic flux required for operation of isolator is looped through a material having good magnetic susceptibility, and heat from the termination is transmitted to the heat sink through a material having high coefficient of heat transmission. Another embodiment of the structure is also described in this disclosure. In second embodiment, the entire housing is made of copper/aluminum, but a magnetic chamber of carbon steel supporting the magnetic loop is pressed into the housing. The termination is soldered directly to the housing and, therefore, the same efficiency for the heat dissipation as for the preferred embodiment is achieved.

8 Claims, 2 Drawing Sheets

NONRECIPROCAL DEVICE HAVING HEAT TRANSMISSION ARRANGEMENT

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A MICROFICHE APPENDIX

Not applicable

BACKGROUND OF THE INVENTION

The present invention relates generally to the microwave ferrite devices and more particularly to an improvement of heat transmission from a surface mount termination that is the main heat source in isolators, to the mounting base, which, in operation, is installed on a heat sink. It specifically relates to isolators having a resistive termination to shunt the reflected energy to the ground in combination with a ferro-magnetic housing for closing a magnetic loop in magnetic chamber.

There are contradictory requirements to the isolator housing in conducting the magnetic flux, and, at the same time, increasing the heat transmission. For a magnetic flux the housing made of mild steel is needed—the material having high magnetic susceptibility ($\mu$>1000) but low coefficient of heat transmission (0.00062 BTU per second). For a good heat transmission the materials like copper or aluminum are needed (0.00404 and 0.00203 BTU per second, respectively) which do not have any magnetic susceptibility (they are diamagnetic). Therefore, many attempts have been done in the past to improve isolators' performance by combining these two materials in the most effective way. For example, Naohiko Kanbayashi teaches (U.S. Pat. No. 3,621,476) a nonreciprocal device in which some portions of a heat dissipating plate or heat sink are introduced into a magnetic chamber through apertures thereof and are made in close contact with the chamber (which houses microwave ferrite elements and a center conductor). This structure, however, is pretty complex and does not cover the isolators wherein the resistive element, a termination—the most substantial source of the heat, is situated outside of the magnetic chamber.

Also known is a prior art where one portion of the housing having a steel magnetic chamber with ferrite elements and a center conductor, and the other portion made of copper or aluminum where the termination is located. This prior art is shown in FIG. 1A wherein the termination 1*a* is situated in the copper/aluminum portion 2*a* (shaded by dots) and secured to the steel portion 3*a* by screws 4*a*. Ferrite elements (not shown) and the center conductor 5*a* (lead portions are only seen) are situated in the steel magnetic chamber which is closed by a steel cover 6*a* that closes the loop of the magnetic flux within the portion 3*a*. Thus, both contradictory requirements are reconciled. The drawback of the structure is the complexity of the two-portion alignment (a close coplanarity tolerance of overall structure is needed to create a flat common surface of the mounting base) and, accordingly, relatively high labor amount and cost are involved in assembly process. This two-portion structure also has lower reliability in handling and operation as compare with one portion housing devices.

Prior art with one-portion housing isolator is also known (see FIG. 2A). In this structure an intermediate copper/aluminum plate 7*a* is used, which is situated between the housing 8*a* and the termination 9*a*. So, at least a part of the heat transmission path passes in the material with much higher heat transmission coefficient than that in the steel housing. There are also drawbacks in the design. Firstly, part of the dissipation path still remains in a steel housing causing in operation a possibility for termination to be overheated. Secondly, the plate 7*a* needs to be secured in the housing 8*a* without any voids. Otherwise, in case of moisture, say, condensation, a detrimental galvanic couple of dissimilar metals can be formed in the voids, causing corrosion.

Thus, what is needed is an isolator that can provide both good magnetic susceptibility in the magnetic chamber and high coefficient of the heat transmission in the heat path from the termination to the mounting base of a device. This isolator should be of simple structure, easy to assemble and reliable in operation.

BRIEF SUMMARY OF THE INVENTION

In accordance with the present invention an isolator's housing, made of a material having good magnetic susceptibility, for example mild steel, includes a top surface, a mounting base, and also a magnetic chamber. A surface-mount resistive termination to be grounded in operation is situated on the top surface. The mounting base to be contacted with a heat sink in operation, has a through hole right under the termination. This hole is completed with a plug made of a material having high coefficient of heat transmission, for example copper/aluminum. The plug connects the termination, both mechanically and electrically, with the mounting base of the housing. The magnetic chamber contains a central stuck incorporating the magnets, ferrites and the center conductor.

The plug is shaped as a cylinder and can be pressed into the hole in the housing from the mounting base side. Pressing with a flat plate during the assembling (common practice) allows positioning the plug exactly flush with the mounting base surface. Thus, required coplanarity to the mounting base with a tight tolerance on flatness can be easily obtained. At the same time, the press fit helps avoiding the voids in the area of dissimilar metals contact, and, by this, excludes forming a detrimental galvanic couple.

The termination is secured to the plug on the top surface of the housing, for example by soldering. For the best results, the plug should be flush with or slightly above the top surface of the housing. In this case, the solder fills the entire area under the termination and creates a reliable electrical and mechanical contact with the plug.

Thus, a simple and inexpensive isolator structure of single-portion ferro-magnetic housing in combination with material capable of effectively transmitting the heat from termination to a mounting base is in accordance with the present invention.

It is an object of the present invention to have a structure of isolator wherein good magnetic susceptibility and high ability to transmit a heat are effectively combined.

It is a further object of the present invention to have a structure of an isolator wherein the termination body would be connected to the mounting base of the housing both mechanically (for heat transmission) and electrically (for grounding).

It is a further object of the present invention to have a structure of heat transmission path wherein the presence of two dissimilar metals would not create a detrimental galvanic couple leading to the corrosion.

It is a further object of the present invention to have the isolator with tight tolerance to the flatness of its mounting base where different parts are exposed, which could be achieved in a simple and inexpensive way (just by pressing and without any secondary machining).

It is an advantage of the present invention that the pressed-on plug actually excludes any voids in the area of bimetallic contact, because for pressing fit the high quality surfaces and tight tolerances are intrinsically needed. That is easily achieving in the present invention by pressing a cylindrical plug and a round hole.

It is another advantage of the present invention that the flatness of the mounting base with tight tolerance requirement, or coplanarity, is easily achieved by pressing the plug into the housing using just the flat press plates. The usage of the flat plates in the pressing practice is very common and does not invoke any additional expenses.

DETAILED DESCRIPTION OF THE INVENTION

Figure 1:
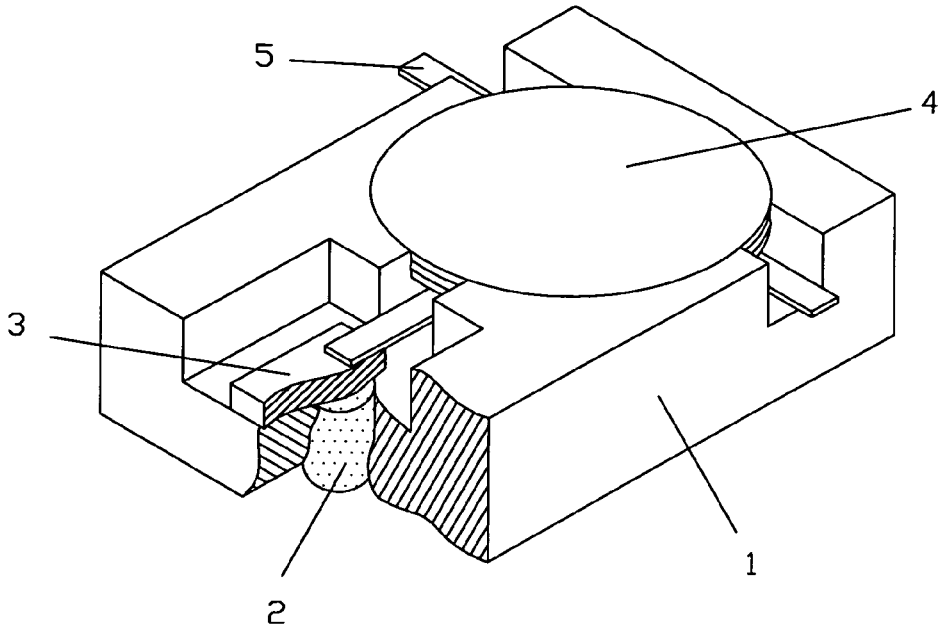
FIG. 1 is a perspective view of the preferred embodiment of isolator according to the present invention, which is partially sectioned to show copper/aluminum plug (shaded with dots).

Referring to FIG. 1 the structure according to the present invention comprises a housing 1, a plug 2, a surface-mount resistive termination 3, a cover 4 and a central stack 5 incorporating magnet, ferrite and the center conductor (only lead portions of central conductor are shown). There is a chamber (not shown) in the housing 1 wherein the assembly 5 is situated. The housing 1 is made of material having good magnetic susceptibility, for example mild steel, to provide an appropriate path for a magnetic flux in the chamber required for an isolator to work. The cover 4 also made of mild steel closes the chamber and magnetic flux loop. The chamber is often referred to as a magnetic chamber.

There is a through hole in the housing 1 completed with the plug 2 made of material having high coefficient of heat transmission, for example copper/aluminum. The plug 2 has a cylindrical shape with both ends perpendicular to its longitudinal axis. On top end (as shown) of the plug 2 the termination 3 is secured, for example, by solder. Bottom end of the plug 2 is coplanar with the bottom surface (as shown) of the housing 1 which is a mounting base of the isolator. In operation, the isolator is mounted to a heat sink (not shown) which makes contact with a mounting base and, accordingly, with the lower end of the plug 2.

The length of the plug 2 is equal to or a slightly higher (by applying appropriate tolerances in designing) than the length of the hole in the housing 1. With coplanarity of the lower end to the mounting base, it assumes that the upper end of the plug 2 will be either flush to or slightly above of the upper surface of the housing 1 in the area of location of the plug 2. This provides the optimal conditions for soldering.

The plug 2 is inserted into the hole with press fit. In order to provide a coplanarity of the lower end of the plug 2 with the mounting base of the housing 1, at the assembling the plug 2 is rammed into the housing 1 by flat pressing plate. The size across the pressing plate shall be substantially larger than that of the plug 2. If that is the case (commonly it is, unless it is deliberately changed) the pressing process ends when the pressing plate stops when it meets the mounting base of the housing 1 and, accordingly, the low end of the plug 2 is flush with the base. This is common practice in pressing process and is described here only to illustrate how easily the coplanarity can be achieved in the structure according to the present invention.

In operation, the isolator is installed on a heat sink providing a contact with the housing's 1 installation base. The plug 2 transmits the heat from the termination 3 to the heat sink in the most efficient way because of the high coefficient of heat transmission in copper/aluminum material.

Figure 2:
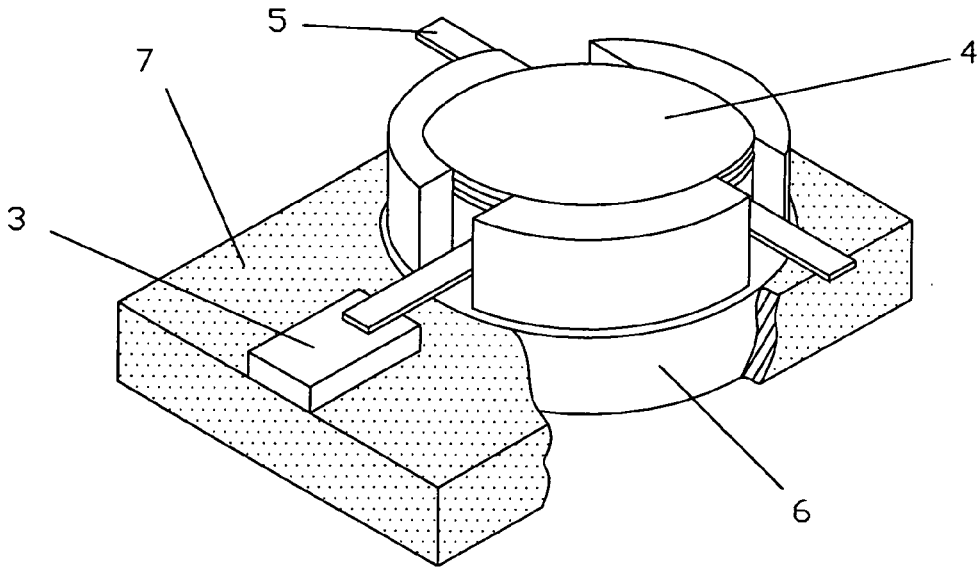
FIG. 2 is a perspective view of another embodiment of the isolator according to the present invention. Copper/aluminum portion (shaded with dots) is partially sectioned to show a mild steel portion (unshaded).
Figure 1A:
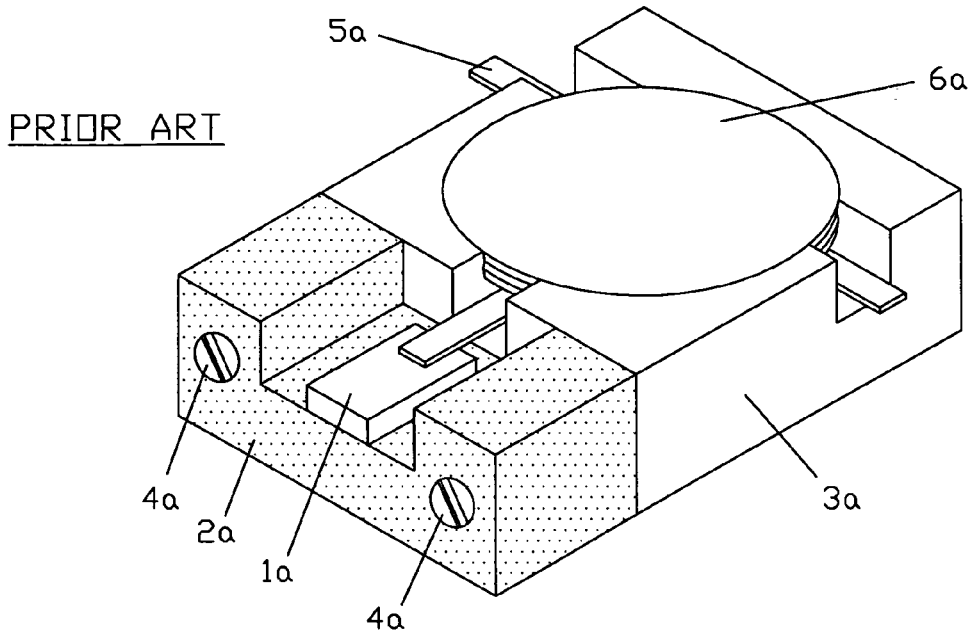
FIG. 1A is a perspective view of a prior art isolator having two-portion housing, one made of mild steel (unshaded) and another of copper/aluminum (shaded with dots).
Figure 2A:
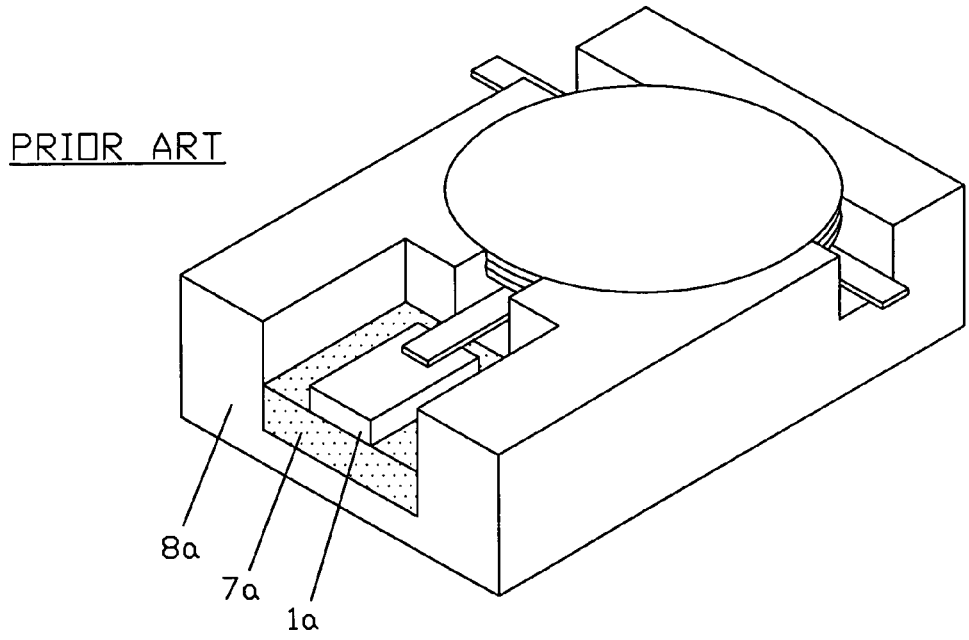
FIG. 2A is a perspective view of a prior art isolator having mild steel housing (unshaded) with copper/aluminum pad (shaded with dots).

One of the possible embodiments of the structure in accordance with present invention has shown in FIG. 2. In this embodiment a mild steel magnetic chamber 6 comprising the assembly 5 and cover 4 is pressed into the copper/aluminum housing 7 (shaded with dots). The termination 3 is secured to the housing 7, for example, by solder. At the assembling, the magnetic chamber 6 is pressing into the housing 7 from its lower surface (as shown) in the same way as the plug 2 into the housing 1, which was described above. To simplify the pressing process, the magnetic chamber 6 has two outside portions: one having larger diameter than the other has. The portion having larger diameter makes contact with and has the same height as the housing 7. Therefore, at the pressing, a ram stroke reduces to the height of the larger diameter portion. Surface of the magnetic chamber 6, which is machined with a tight tolerance to sustain the press fit is also reduced to the height of the housing 7.

Thus, a simple and inexpensive structure to reconcile contradictory requirements to isolators having a housing with a good magnetic susceptibility and, at the same time, a high coefficient of heat transmission is proposed. While the invention having been described in detail, it is clear that there are variations and modifications to this disclosure here and above which will be readily apparent to one of ordinary skill in the art. For example, one of the obvious variations is having the entire housing made of copper/aluminum with pressed-on magnetic chamber made of mild carbon steel, as described above as an another embodiment. To the extent that such variations and modifications provide an adequate path from heat source to heat sink in one-portion housing isolators and, at the same time, have good magnetic susceptibility in the magnetic chamber, which result in better performance and cost-labor savings, such are deemed within the scope of present invention.

We claim:

1. A nonreciprocal device having heat dissipating arrangement, comprising:

a housing having a mounting base, a top surface, a chamber with a cover;

a termination having a soldering base, a resistive element;

a central stack composed of magnet, ferrite and center conductor situated inside said chamber and having leads extending outside said chamber, one of said leads making electrical contact with said resistive element of said termination to set up an isolator, wherein said housing made of material with good magnetic susceptibility, having a through hole perpendicular to said mounting base and located right under said termination, said hole is completed with a plug made of material having a high coefficient of heat transmission and said soldering base of said termination is mechanically and electrically connected to said plug to provide heat transmission and grounding.

2. A structure as recited in claim 1, wherein said plug is pressed into said hole in said housing from said mounting base to be flush with said mounting base and from being flush to slightly above position relationship with said top surface of said housing.

3. A structure as recited in claim 1, wherein said soldering base of said termination is secured to said top surface of said housing and said plug by solder.

4. A structure as recited in claim 1, wherein said housing material is mild carbon steel.

5. A structure as recited in claim 1, wherein said plug material is copper.

6. A structure as recited in claim 1, wherein said plug material is aluminum.

7. A structure as recited in claim 1, wherein said chamber is closed by said cover which is screwed on said housing.

8. A structure as recited in claim 1, wherein said chamber is closed by said cover which is soldered to said housing.

* * * * *